US005448782A

United States Patent [19]

Ratajac

[11] Patent Number: 5,448,782

[45] Date of Patent: Sep. 12, 1995

[54] FOOT ACTUATED TOILET SEAT LIFTING DEVICE

[76] Inventor: Aleksandar Ratajac, 5182 Biltmore St., San Diego, Calif. 92117

[21] Appl. No.: 220,748

[22] Filed: Mar. 31, 1994

[51] Int. Cl.[6] ..... A47K 13/10

[52] U.S. Cl. ..... 4/246.5; 4/248

[58] Field of Search ..... 4/246.2, 246.4, 246.5, 4/248

[56] References Cited

U.S. PATENT DOCUMENTS

| | | | |
|---|---|---|---|
| 1,877,083 | 9/1932 | Thrasher | 4/246.5 |
| 3,345,650 | 10/1967 | Waters | 4/246.5 |
| 3,504,385 | 4/1970 | Fields | 4/246.5 |
| 5,029,347 | 7/1991 | Lin | 4/246.2 |

FOREIGN PATENT DOCUMENTS

| | | | |
|---|---|---|---|
| 0218161 | 7/1924 | United Kingdom | 4/246.5 |

*Primary Examiner*—Robert M. Fetsuga

*Attorney, Agent, or Firm*—Charles C. Logan, II

[57] ABSTRACT

A foot actuated toilet seat lifting device having an adjustable width toilet seat attachment bracket, a telescoping lifting arm assembly, an actuator lever, a fluid pressure cylinder, and a base assembly. The rear end of the fluid pressure cylinder is pivotally secured to the base assembly and the front end of its piston rod is pivotally secured to the actuator lever intermediate its front and rear ends. The actuator lever is secured to a transversely extending axle mounted in the base assembly. A foot pedal assembly is mounted on the front end of the actuator level. When the foot pedal is depressed, the actuator level pivots around its axle and lifts the telescoping lifting arm assembly tube upwardly. This causes the toilet seat attachment bracket secured to its upper end to lift the toilet seat through a predetermined upward angle. The fluid pressure cylinder allows the toilet seat to be automatically slowly lowered to its horizontal position upon release of pressure on the foot pedal assembly.

8 Claims, 2 Drawing Sheets

FOOT ACTUATED TOILET SEAT LIFTING DEVICE

BACKGROUND OF THE INVENTION

The present invention relates to sanitary devices and more. particularly to a novel toilet seat raising apparatus that allows the user to automatically raise and lower the toilet seat without using their hands and without touching the seat itself.

Many prior art toilet seat lifting devices are known, which permit the user to raise the toilet seat by stepping upon a pedal. By the use of levers, rods, cables, or fluid displacing pistons, the force of the users foot is transmitted to the toilet seat, so that the seat may be lifted without soiling the hands and without the inconvenience of bending down to reach the seat.

Although some such prior art devices are functional, they have not achieved wide acceptance and use in the United States. This lack of acceptance is believed to be due, at least in part, to several disadvantages inherent in the design of the prior art devices. Some devices, such as that disclosed in the Kemp U.S. Pat. No. 3,055,016 are mechanically complex and could therefore be prohibitively expensive to manufacture. Simpler and perhaps less costly devices, such as that disclosed in the Svedelius U.S. Pat. No. 1,999,070 have failed to provide any form of adjustment to fit toilets of varying heights. Some prior art devices must also be rigidly attached to the toilet and/or to the floor nearby to permit proper functioning. A practice of rigid, permanent attachment has made cleaning of the toilet unnecessarily awkward, since the device may not be easily removed for regular cleaning.

It is an object of the invention to provide a novel foot actuated toilet seat lifting device having a toilet seat attachment bracket that can be secured to different widths of toilet seats.

It is also an object of the invention to provide a novel foot actuated toilet seat lifting device that has a telescoping lifting arm assembly which allows the invention to be installed on toilet seats of varying heights.

It is another object of the invention to provide a novel foot actuated toilet seat lifting device that can be quickly and easily installed or removed from the seat of a toilet.

It is an additional object of the invention to provide a novel foot actuated toilet seat lifting device that has a fluid pressure cylinder with a bleed screw so that the speed at which the toilet seat lowers itself can be adjusted.

It is a further object of the invention to provide a novel foot actuated toilet seat lifting device that is economical to manufacture and market.

SUMMARY OF THE INVENTION

The novel foot actuated toilet seat lifting device only requires the base assembly be properly positioned adjacent the side of the toilet bowl so that the toilet seat attachment bracket can be secured to the toilet seat approximately four inches from the pivot axis. The telescoping lifting arm assembly can have its length adjusted to conform to the height of the top of the toilet bowl. These are the only adjustments and installation steps required to be made in order to make the device operational.

When properly setup, the user presses down on the foot pedal assembly for as long as there wishes the toilet seat to be raised. Upon removal of the person's foot from the foot pedal assembly, the fluid pressure cylinder controls the speed at which the toilet seat is automatically lowered to its horizontal position.

DESCRIPTION OF THE PREFERRED EMBODIMENT

The novel foot actuated toilet seat lifting device will now be described by referring to FIGS. 1–7 of the drawings. The foot actuated toilet seat lifting device is generally designated numeral 10.

Figure 2:
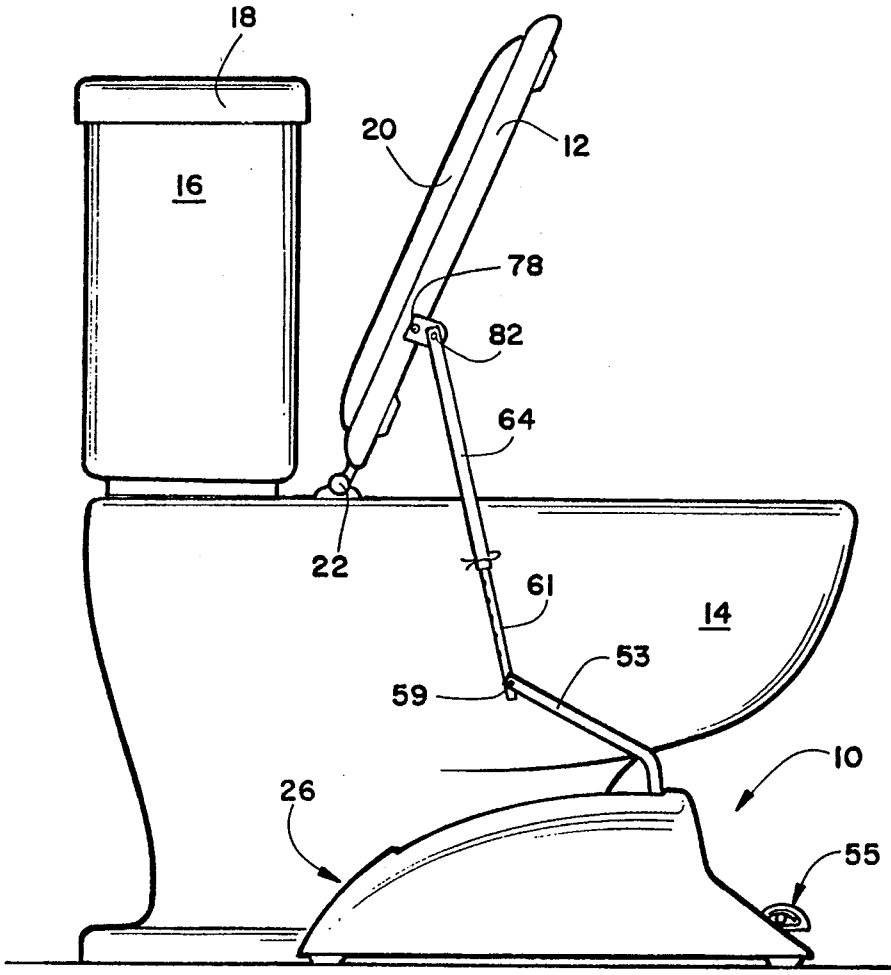
FIG. 2 is a front elevation view of the novel foot actuated toilet seat lifting device connected to the toilet seat showing the seat in its lowered horizontal position.
Figure 1:
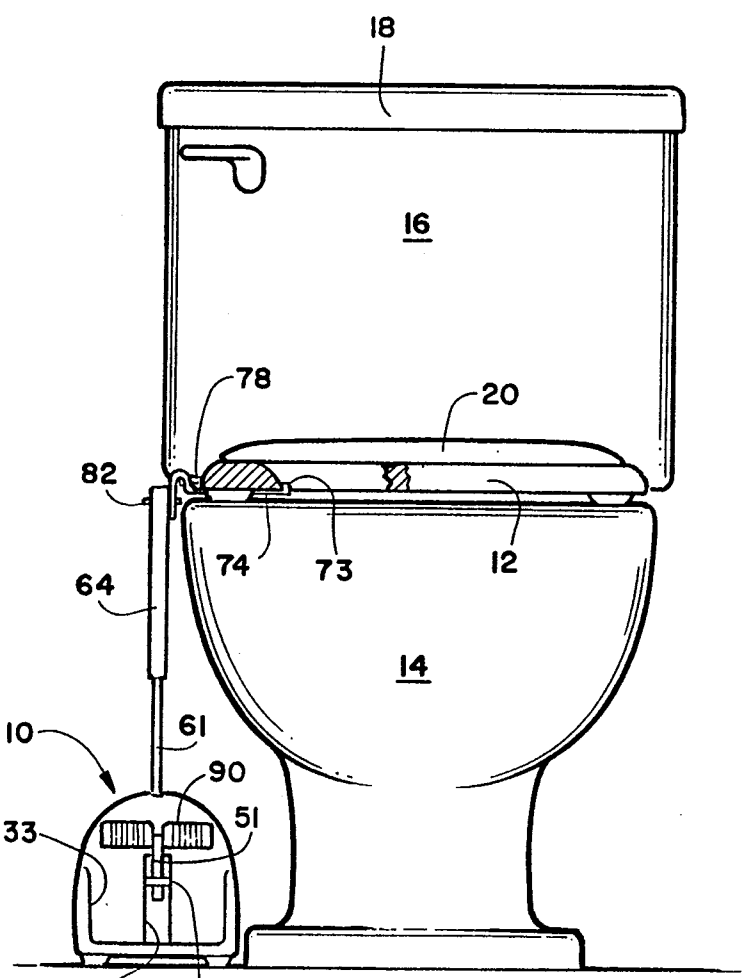
FIG. 1 is a side elevation view illustrating the novel foot actuated toilet seat lifting device connected to the toilet seat with the seat in its elevated position.
Figure 7:
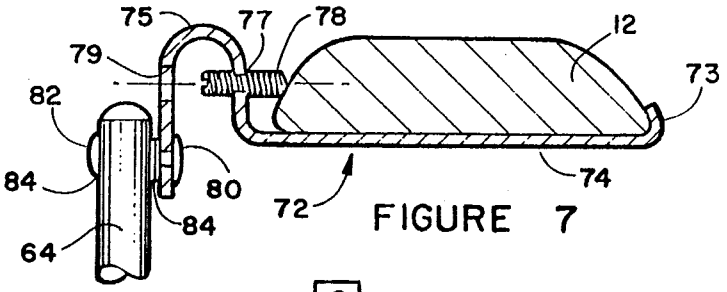
FIG. 7 is an enlarged front elevation view of the attachment bracket secured to the toilet seat.
Figure 4:
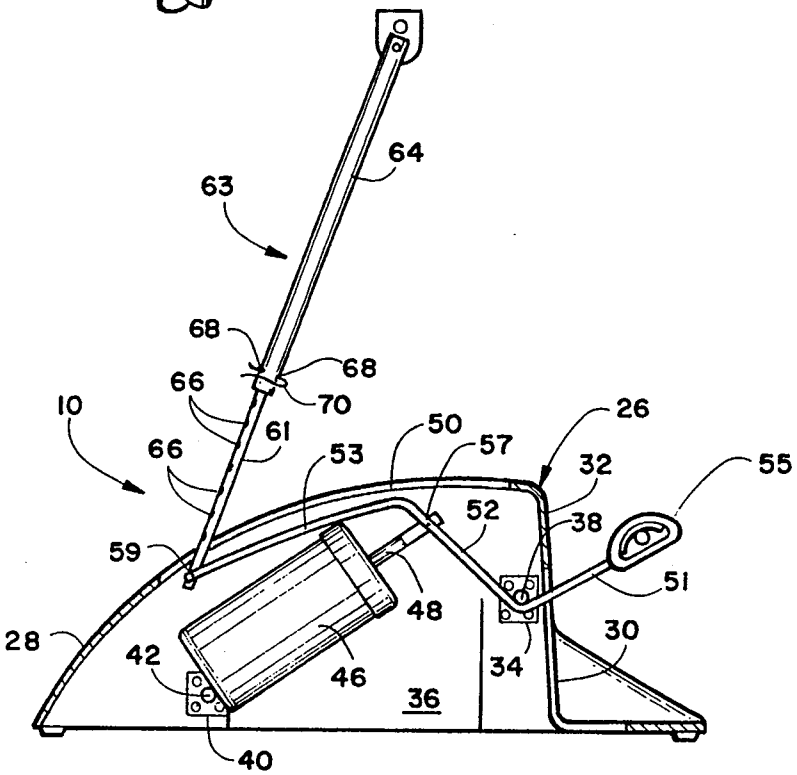
FIG. 4 is a cross sectional view taken along lines 4—4 of FIG. 3 with the foot pedal assembly in the raised position.
Figure 3:
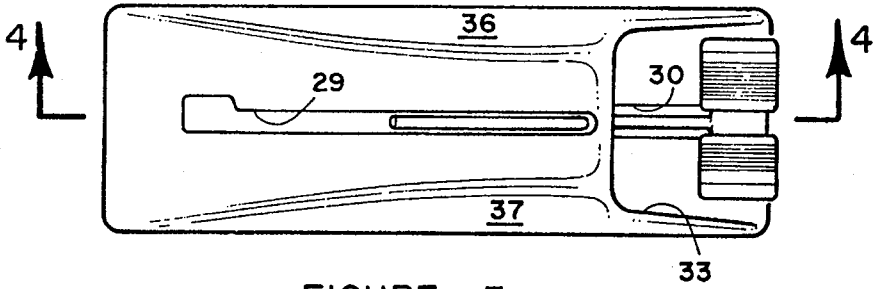
FIG. 3 is a top plan view of the base assembly of the novel foot actuated toilet seat lifting device.
Figure 5:
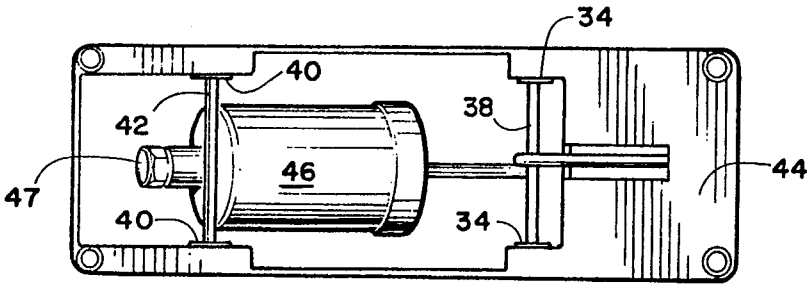
FIG. 5 is a bottom plan view of the base assembly of the novel foot actuated toilet seat lifting device.
Figure 6:
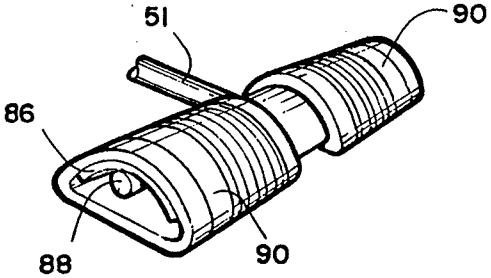
FIG. 6 is a front perspective view of the foot pedal assembly.

In FIGS. 1 and 2, foot actuated toilet seat lifting device 10 is illustrated connected to toilet seat 12 of toilet bowl 14. Mounted on the rear end of toilet bowl 14 is a water tank 16 having a cover 18. A toilet seat cover 20 rests on toilet seat 12. Toilet seat 12 has its rear end secured to toilet bowl 14 by hinge structure 22.

The specific structure of foot actuated toilet seat lifting device 10 is best understood by referring to FIGS. 3–7. It has a base assembly 26 having a molded plastic cover 28 having a longitudinally extending slot 29 in its top surface and an elongated slot 30 formed in the front wall 32 of molded recess 33. A pair of laterally spaced bearing brackets 34 are mounted on the interior surface of side walls 36 and 37. An axle 38 has its opposite ends journaled in these bearing brackets. A pair of laterally spaced bearing brackets 40 are also mounted on the interior surface of side walls 36 and 37. An axle 42 has its opposite ends journaled in the respective bearing brackets 40. Base assembly 26 also has a bottom plate 44.

Fluid pressure cylinder 46 (normally hydraulic or gas) has its rear end welded to axle 42 so that they pivot as one unit. Fluid pressure cylinder 46 also has a leakage control screw 47 and a piston rod 48. Actuator lever 50 has a front portion 51, a central portion 52, and a rear portion 53. A foot pedal assembly 55 is secured to the front end of actuator lever 50.

Actuator lever 50 is welded to axle 38 so that they pivot as a single unit. Pivot pin 57 is connected to the front end of piston rod 48 and central portion 52. Pivot pin 59 connects the rear end of actuator lever 50 to the bottom end of rod member 61. When a person steps on foot pedal assembly 55 and holds their foot thereon, the toilet seat 12 is lifted to the position illustrated in FIG. 1. This is due to the rotation of actuator lever 50 about axle 38.

Telescoping lifting arm assembly 63 includes a rod member 61 that telescopes into tube 64. Rod 61 has a plurality of bore holes 66 and any one of them can be aligned with diametrically opposed bore holes 68 in the lower end of tube 64. A cotter pin 70 is removably received within the aligned bore holes and this allows for changing the total length of the telescoping lifting arm assembly 63 so that it can be installed on toilets having different heights to their toilet bowl.

Adjustable width toilet seat attachment bracket 72 has a flange 73 formed at its front. It also has a flat strip portion 74 extending rearwardly therefrom and an inverted u-shaped portion 75. Inverted u-shaped portion 75 has a threaded bore hole 77 for receiving a screw 78. A screw driver access aperture 79 is aligned with the longitudinal axis of screw 78. An aperture 80 is formed in inverted u-shaped portion 75 and it receives a pin 82 that is journaled in aligned apertures 84 in the top end of tube 64.

Foot pedal assembly 55 has a transversely extending arcuate plate 86 that is welded on transversely extending rod member 88. Rubber covers 90 are installed on the outer surface of arcuate plate 86.

What is claimed is:

1. A foot actuated toilet seat lifting device comprising:

a toilet seat attachment bracket having a front end and a rear end;

a lifting arm assembly having a top end and a bottom end;

first pivot means for pivotally securing the top end of said lifting arm assembly to the rear end of said toilet seat attachment bracket;

an elongated actuator lever having a predetermined configuration and a front end and a rear end, said actuator lever having a front portion, a central portion and a rear portion;

said front portion in its at rest position being inclined upwardly at an acute angle, said front portion makes an obtuse angle to said central portion where they meet each other, said rear portion in its at rest position being inclined downwardly at an acute angle to a horizontal plane passing through the intersection of said central portion and said rear portion, said rear portion makes an obtuse angle to said central portion where they meet each other;

second pivot means for pivotally securing the rear end of said actuator lever to the bottom end of said lifting arm assembly;

a fluid pressure cylinder having a front end, a rear end, and a piston rod having a front end, said fluid pressure cylinder in its at rest position having its front end inclined upwardly at an acute angle;

third pivot means pivotally securing said piston rod to said actuator lever at a point on the central portion of said actuator lever;

a base assembly; said base assembly having a molded plastic cover having a front wall, a rear wall, a top wall, and a pair of laterally spaced side walls, a longitudinal slot is formed in said top wall and the rear portion of said actuator lever passes upwardly through said slot when a toilet seat is raised and the rear portion of said actuator lever remains hidden inside said cover when a toilet seat is in its horizontal position;

fourth pivot means for pivotally securing the rear end of said fluid pressure cylinder to said base assembly; and a fifth pivot means for pivotally securing said actuator lever to said base assembly, said fifth pivot means being located adjacent the intersection of the front portion and the central portion of said actuator lever.

2. A foot actuated toilet seat lifting device as recited in claim 1 wherein said elongated actuator lever is formed of a unitary rod member.

3. A foot actuated toilet seat lifting device as recited in claim 1 wherein said fluid pressure cylinder has a leakage control screw.

4. A foot actuated toilet seat lifting device as recited in claim 1 further comprising a foot pedal connected to the front end of said actuator lever.

5. A foot actuated toilet seat lifting device as recited in claim 1 wherein said lifting arm assembly has means for adjusting its length.

6. A foot actuated toilet seat lifting device as recited in claim 1 wherein said base assembly has a cover having a front wall, a top wall and laterally spaced side walls.

7. A foot actuated toilet seat lifting device as recited in claim 6 herein the front wall of said cover has an elongated slot through which the front portion of said actuator lever protrudes.

8. A foot actuated toilet seat lifting device as recited in claim 1 wherein said toilet seat attachment bracket has adjustable width toilet seat gripping means.

* * * * *